US009437958B2

(12) United States Patent
Naganishi et al.

(10) Patent No.: US 9,437,958 B2
(45) Date of Patent: Sep. 6, 2016

(54) TERMINAL CONNECTING STRUCTURE AND TERMINAL CONNECTING METHOD

(71) Applicant: Yazaki Corporation, Tokyo (JP)

(72) Inventors: Yukinari Naganishi, Makinohara (JP); Kenji Osada, Susono (JP); Tomokazu Yoshida, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/696,582

(22) Filed: Apr. 27, 2015

(65) Prior Publication Data

US 2015/0311623 A1 Oct. 29, 2015

(30) Foreign Application Priority Data

Apr. 28, 2014 (JP) ..... 2014-093005

(51) Int. Cl.

| | |
|---|---|
| ***H01R 4/10*** | (2006.01) |
| ***H01R 13/52*** | (2006.01) |
| ***H01R 11/12*** | (2006.01) |
| ***H01R 25/00*** | (2006.01) |
| ***H01R 11/28*** | (2006.01) |
| ***H01R 13/405*** | (2006.01) |
| ***H01R 43/00*** | (2006.01) |
| ***H01R 43/02*** | (2006.01) |

(52) U.S. Cl.

CPC ..... *H01R 13/521* (2013.01); *H01R 11/12* (2013.01); *H01R 11/281* (2013.01); *H01R 13/405* (2013.01); *H01R 25/003* (2013.01); *H01R 43/005* (2013.01); *H01R 43/0207* (2013.01)

(58) Field of Classification Search

CPC ..... H01R 4/023

USPC ..... 439/879, 604, 203, 936, 883

See application file for complete search history.

(56) References Cited

U.S. PATENT DOCUMENTS 2,350,765 A * 6/1944 Johnson ..... H01R 4/20 439/879
2,815,497 A * 12/1957 Redslob ..... H01R 4/62 174/90
3,568,137 A * 3/1971 Youngblut ..... H01R 4/18 439/865

(Continued)

FOREIGN PATENT DOCUMENTS

EP 1528628 A1 5/2005
JP 3127698 B2 1/2001

(Continued)

OTHER PUBLICATIONS

Communication from the European Patent Office issued Sep. 1, 2015 in a counterpart European Application No. 15165395.3.

*Primary Examiner* — Phuong Dinh
(74) *Attorney, Agent, or Firm* — Sughrue Mion, PLLC

(57) ABSTRACT

A terminal connecting structure includes: an electric wire in which a conductor is covered by an insulative covering; a conductor connecting terminal to which a conductor exposed portion in which the covering of an end portion of the electric wire is removed and the conductor is exposed is electrically connected; a water sealant for molding the conductor connecting terminal; and a fixing terminal which includes a terminal fixing portion that is to be fixed and electrically connected to a mount part, and which is electrically connected to a part of the conductor connecting terminal in a state where the water sealant is removed from the part of the conductor connecting terminal.

7 Claims, 7 Drawing Sheets

(56) References Cited

U.S. PATENT DOCUMENTS 3,732,528 A * 5/1973 Vetter ..... H01R 4/62 174/84 C
6,517,381 B2 * 2/2003 Kondo ..... H01R 4/70 439/604
6,796,781 B2 * 9/2004 Kondo ..... B29C 45/14426 249/95
7,048,562 B2 * 5/2006 Lutsch ..... H01R 4/70 439/275
7,238,884 B2 * 7/2007 Tanaka ..... H01R 13/5216 174/74 R
7,442,097 B2 * 10/2008 Kumakura ..... H01R 43/16 29/851
7,699,654 B2 * 4/2010 Tanaka ..... H01R 13/5216 439/519
7,954,235 B2 * 6/2011 Martauz ..... H01R 4/184 174/84 C
2007/0264865 A1 11/2007 Hagikura et al.
2008/0244889 A1 10/2008 Hagikura et al.

FOREIGN PATENT DOCUMENTS

JP 2003-297447 A 10/2003
JP 2007-305362 A 11/2007
JP 2008-262787 A 10/2008
JP 2011-081918 A 4/2011

* cited by examiner

TERMINAL CONNECTING STRUCTURE AND TERMINAL CONNECTING METHOD

CROSS-REFERENCE TO RELATED APPLICATION(S)

This application is based upon and claims the benefit of priority from prior Japanese patent application No. 2014-093005, filed on Apr. 28, 2014, the entire contents of which are incorporated herein by reference.

BACKGROUND

The present invention relates to a terminal connecting structure, and a terminal connecting method.

In an automobile, many electric or electronic devices are connected to a battery functioning as a power supply, and grounded through a ground terminal fixed to a mount part such as a vehicle body panel. In such a grounding method, a plurality of electric wires constituting electric circuits are assembled (bundled), and connected to the ground terminal by various terminal connecting structures. Terminal connecting structures for the grounding terminal and the like are required to be easily disassembled from viewpoints of: the connection reliability; supplies of requested current and voltage values; prevention of electromagnetic leakage to an adjacent circuit; exclusion of an electric short circuit; the waterproof property; and the like, and further viewpoints of: easiness of the work of mounting to a vehicle; ensuring of the mounting reliability; and resource conservation.

In the attachment structure which is disclosed in JP-A-2007-305362, and in which a ground terminal is fixed to a body panel, as shown in FIG. 7A, for example, electric wires 501 are crimped by wire crimping claws 525 of a ground terminal 523, and thermocompression bonding parts of bare wires are thermocompression bonded to a thermocompression bonding surface 527 of the ground terminal 523. The ground terminal 523 is fixed to the body panel (mount part) 535 by the tightening force of a bolt 529 and a nut 531, and the engaging force exerted by body fixing claws 533. In the ground terminal 523, the crimping force and the thermocompression bonding force are set to be smaller than the fixing force. Therefore, when the electric wires 501 are torn off in a direction perpendicular to the thermocompression bonding surface 527 of the ground terminal 523, the wires 501 can be removed from the body panel 535 without detaching the bolt 529 and the nut 531. It is not necessary to forma fracture groove in the ground terminal 523, and therefore the electric resistance is not increased during energization. Even when the force for removing the wires 501 is set to be small, factors in causing production irregularities are hardly introduced, and easy disassemblability can be readily provided and applied to mass-produced products.

In the waterproofing structure for a waterproofing bolted terminal which is disclosed in JP-A-2008-262787, as shown in FIG. 7B, conductor exposed portions 503 in the tip ends of electric wires 501 are connected to a conductor connecting portion 507 that is formed in one end of a terminal 505, and insulated covering portions 509 of the electric wires 501 are held by an insulated covering holding portion 511 that is formed in the other end of the terminal 505. Crimp pieces 513 which are extended from the upper ends of sidewalls of the insulated covering holding portion 511 are disposed in the both ends of the insulated covering holding portion. On the lateral side of a wire fixing portion 515 configured by the conductor connecting portion 507 and the insulated covering holding portion 511, a bolt tightening plate 517 which is to be fixed to a mating member is projected with being located on the side of the insulated covering holding portion 511. The conductor connecting portion 507, the conductor exposed portions 503, and end portions of the insulated covering portions 509 are immersed in a water sealant 519 to be molded. This causes the water sealant 519 to penetrate gaps between the insulated coverings of the electric wires 501 and conductors 521, and the conductors 521, and the waterproof property is ensured.

In the related-art grounding method in which grounding is performed through a ground terminal fixed to a body panel, as described above, the electric wires 501 are connected to the grounding point (bolt 529) of the body panel 535 (mount part) while collecting the wires 501 by using the ground terminal 523, or to the body (mount part) while collecting the wires 501 by using a joint (a bonder or a joint connector). In the related-art grounding method, namely, a terminal connecting structure such as a grounding terminal is used, and the electrical connection to the minus terminal of a battery is conducted through the body.

When the water sealant 519 is to be disposed in the conductor connecting portion 507 where the conductor exposed portions 503 of the wires 501, and the terminal 505 are connected (by thermal welding or ultrasonic connection) to each other, however, the water sealant 519 must be disposed only in the conductor connecting portion 507. Therefore, masking steps or the like must be usually added, and hence the production cost is increased. In the waterproofing structure shown in FIG. 7B, the terminal 505 cannot have a configuration where the bolt tightening plate 517 is disposed at the tip end.

SUMMARY

It is an object of the invention to provide a terminal connecting structure and method in which masking is not necessary, and waterproof and corrosion proof are enabled by the dipping method.

In order to achieve the object, according to an aspect of the invention, there is provided a A terminal connecting structure comprising: an electric wire in which a conductor is covered by an insulative covering; a conductor connecting terminal to which a conductor exposed portion in which the covering of an end portion of the electric wire is removed and the conductor is exposed is electrically connected; a water sealant for molding the conductor connecting terminal; and a fixing terminal which includes a terminal fixing portion that is to be fixed and electrically connected to a mount part, and which is electrically connected to a part of the conductor connecting terminal in a state where the water sealant is removed from the part of the conductor connecting terminal.

The terminal connecting structure may be fixed to the mount part in a state where the terminal fixing portions of a plurality of the fixing terminals are electrically connected to each other.

The water sealant which covers a fixing-terminal connecting portion of the conductor connecting terminal contacting with the fixing terminal may be scraped and removed by a fitting operation when the conductor connecting terminal and the fixing terminal are fitted to each other.

The water sealant which covers a fixing-terminal connecting portion of the conductor connecting terminal contacting with the fixing terminal may be melted and removed by heat due to thermal bonding when the conductor connecting terminal and the fixing terminal are thermally bonded to each other.

The water sealant which covers a fixing-terminal connecting portion of the conductor connecting terminal contacting with the fixing terminal may be removed by vibrations and heat due to ultrasonic connection when the conductor connecting terminal and the fixing terminal are ultrasonically connected to each other.

There is also provided a terminal connecting method comprising: exposing a conductor of an end portion of an electric wire in which the conductor is covered by an insulative covering; electrically connecting a conductor exposed portion of the electric wire in which the conductor is exposed, to a conductor connecting terminal; molding at least the conductor exposed portion in the conductor connecting terminal, with a water sealant; and electrically connecting a part of the conductor connecting terminal to a fixing terminal which includes a terminal fixing portion that is to be fixed and electrically connected to a mount part, while removing the water sealant from the part of the conductor connecting terminal.

In the above, the invention has been briefly described. When a mode for carrying out the invention (hereinafter, referred to as "embodiment") which will be described below is through read with reference to the accompanying drawings, a detail of the invention will be further clarified.

DETAILED DESCRIPTION OF EXEMPLARY EMBODIMENTS

Hereinafter, an embodiment of the invention will be described with reference to the drawings.

Figure 1:
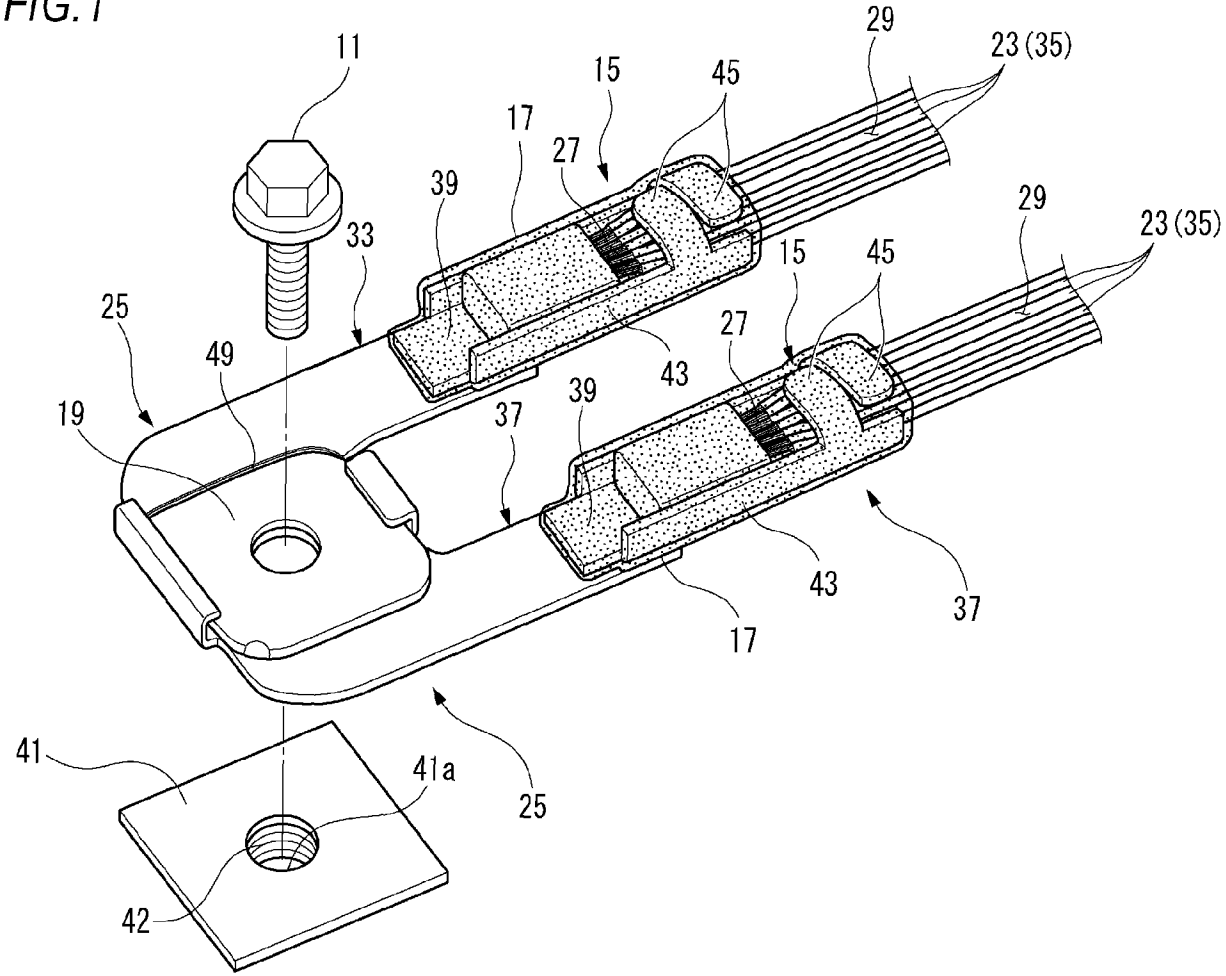
FIG. 1 is a perspective view showing a use state of a pair of connecting terminals including a terminal connecting structure of an embodiment of the invention.
Figure 2:
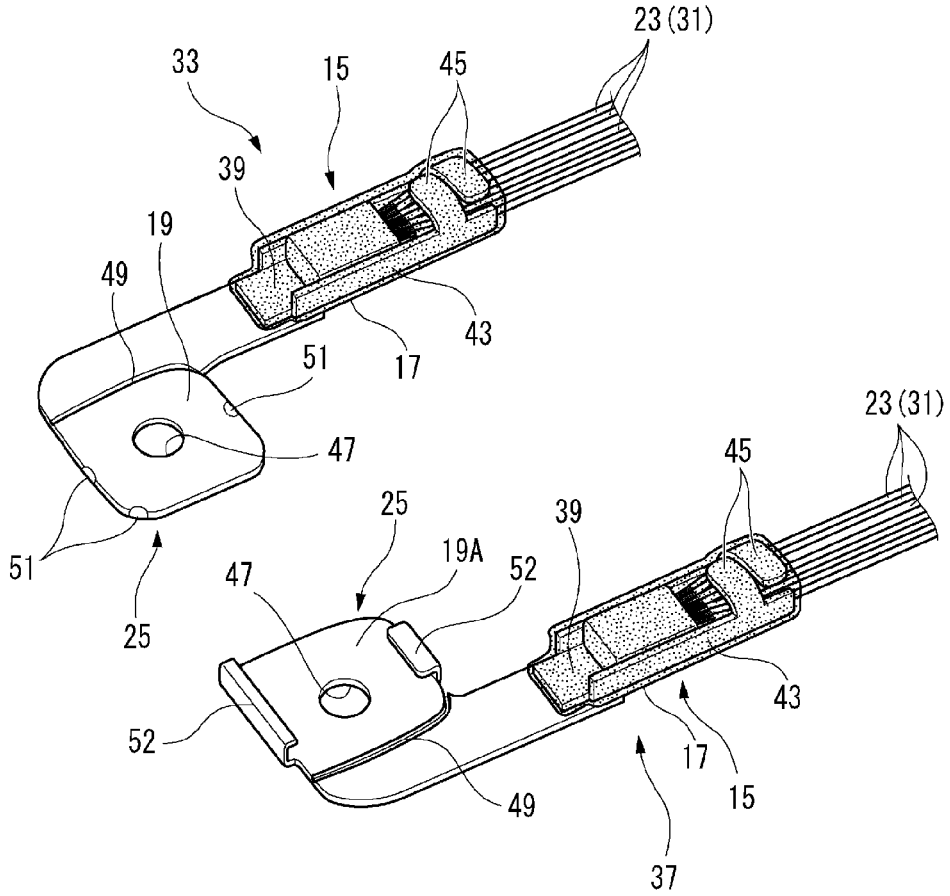
FIG. 2 is a perspective view showing a state where the pair of connecting terminals shown in FIG. 1 are separated from each other.

As shown in FIGS. 1 and 2, connecting terminals including a terminal connecting structure of the embodiment of the invention are an aluminum-wire connecting terminal 33 and a copper-wire connecting terminal 37. In each of a plurality of electric wires 23 which are to be electrically connected to the aluminum-wire connecting terminal 33 and the copper-wire connecting terminal 37, a conductor 27 is covered by an insulative covering 29. The electric wires 23 are connected to auxiliary apparatuses, respectively. The conductor 27 may be configured by a plurality of element wires, or alternatively by a single element wire. In the electric wires 23 in the embodiment, the conductor 27 is configured by an aluminum conductor or a copper conductor. In the embodiment, aluminum wires 31 having an aluminum conductor are connected to the aluminum-wire connecting terminal 33, and copper wires 35 having a copper conductor are connected to the copper-wire connecting terminal 37. Each of the aluminum-wire connecting terminal 33 and the copper-wire connecting terminal 37 is configured by a conductor connecting terminal 15 and a fixing terminal 25.

Figure 3A:
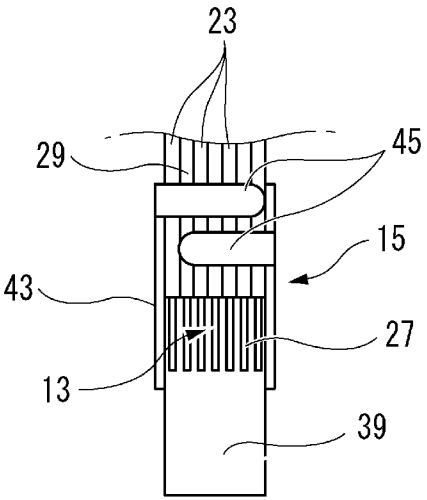
FIGS. 3A to 3C are diagrams showing a step of waterproofing the connecting terminal shown in FIG. 2.

As shown in FIG. 3A, conductor exposed portions 13 in each of which the covering 29 in an end portion of the wire 23 is removed, and the conductor 27 is exposed are electrically connected to the conductor connecting terminal 15. The conductor connecting terminal 15 to which the conductor exposed portions 13 are connected is molded with a water sealant 17. A fixing-terminal connecting portion 39 is formed in the conductor connecting terminal 15. The conductor connecting terminal 15 is connected to the fixing terminal 25 through the fixing-terminal connecting portion 39.

The fixing terminals 25 which cooperate with the conductor connecting terminals 15 to configure the aluminum-wire connecting terminal 33 and the copper-wire connecting terminal 37 have terminal fixing portions 19, 19A which are to be fixed to a body panel (mount member) 41 to be electrically connected thereto, respectively. The fixing terminals 25 are electrically connected to the conductor connecting terminals 15 in a state where the water sealant 17 of the fixing-terminal connecting portions 39 is removed.

Figure 4C:
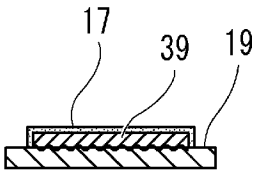
FIG. 4C is a sectional view taken along line A-A in FIG. 4B.
Figure 4B:
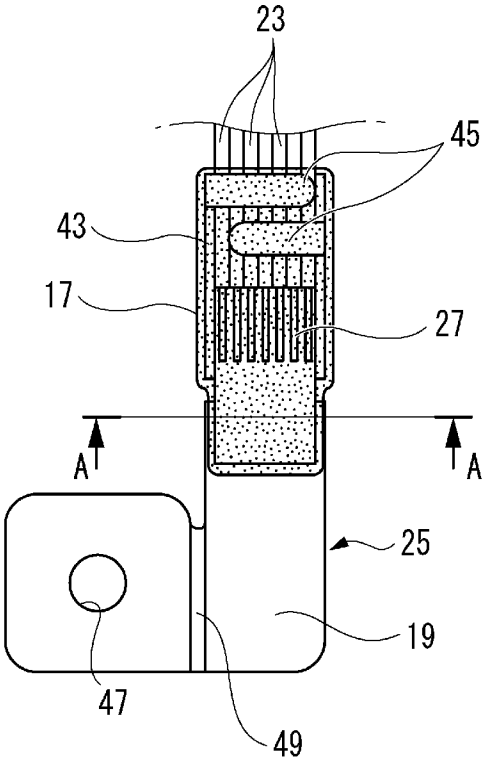
FIGS. 4A and 4B are diagrams illustrating a step of connecting the connecting terminal shown in FIG. 2.
Figure 4A:
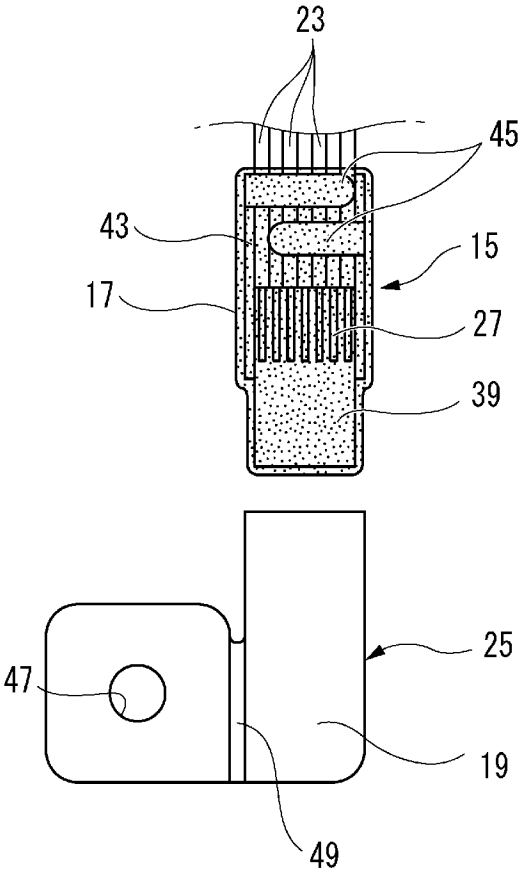

The terminal connecting structure of the embodiment may be configured so that, as shown in FIGS. 4A to 4C, the water sealant 17 which covers the fixing-terminal connecting portions 39 of the conductor connecting terminals 15 that are in contact with the fixing terminals 25 is melted and removed by heat due to thermal bonding between the conductor connecting terminals 15 and the fixing terminals 25.

Figure 5A:
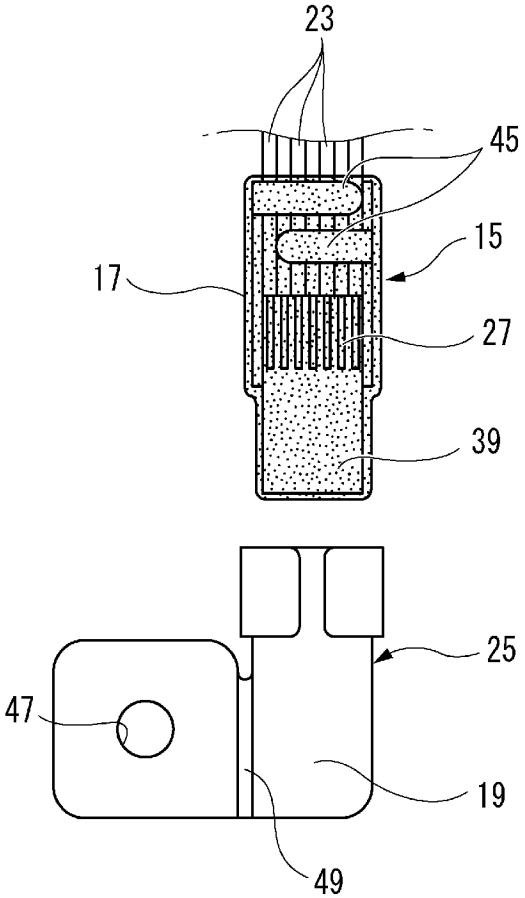
FIGS. 5A and 5B are diagrams illustrating another of step connecting the connecting terminal shown in FIG. 2.
Figure 5B:
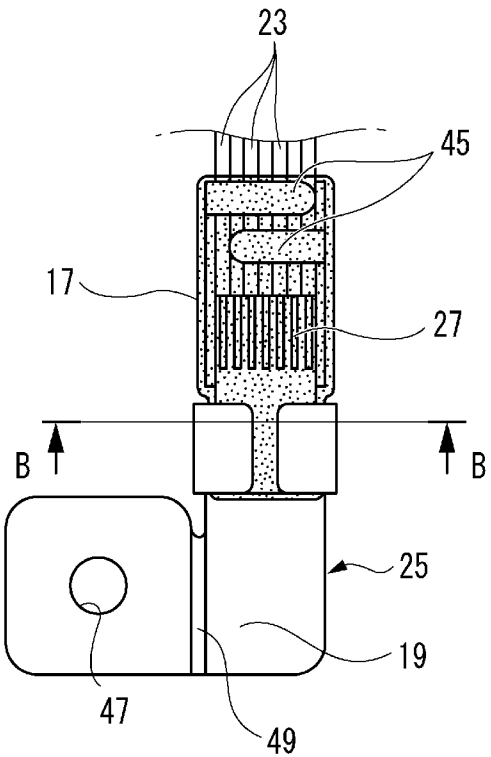
Figure 5C:
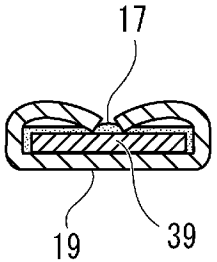
FIG. 5C is a sectional view taken along line B-B in FIG. 5B.

Alternatively, the terminal connecting structure of the embodiment may be configured so that, as shown in FIGS. 5A to 5C, the water sealant 17 which covers the fixing-terminal connecting portions 39 of the conductor connecting terminals 15 that are in contact with the fixing terminals 25 is scraped by fitting of fitting structures between the conductor connecting terminals 15 and the fixing terminals 25.

In each of the aluminum wires 31 and copper wires 35 in the embodiment, a part of the covering 29 of the end portion is removed, and the conductor exposed portion 13 in which the conductor 27 is exposed is formed. The aluminum-wire connecting terminal 33 and the copper-wire connecting terminal 37 have the terminal fixing portions 19, 19A which are to be fixed to the body panel (mount member) 41 to be electrically connected thereto, respectively. The body panel (mount member) 41 is connected to the minus terminal of a battery which is not shown. Namely, the aluminum-wire connecting terminal 33 and the copper-wire connecting terminal 37 are electrically connected to, for example, the minus terminal of the battery through the body panel 41. It is a matter of course that the connecting terminal in the invention is not limited to a terminal which is to be connected to the minus terminal of a battery.

In each of the aluminum-wire connecting terminal 33 and the copper-wire connecting terminal 37, as shown in FIG. 2, a pair of crimping claws 45 which crimp the coverings 29 of the wires 23 from the outer circumferential side are formed on the rear end side (the side opposite to the terminal fixing portion 19 or 19A) of a conductor connecting portion 43.

The fixing terminal 25 of the aluminum-wire connecting terminal 33 has the terminal fixing portion 19. The terminal fixing portion 19 is formed into a substantially square plate-like shape which is wider than the conductor connecting portion 43. The terminal fixing portion 19 is formed while being laterally eccentric to the center line of the conductor connecting portion 43. By contrast, the terminal fixing portion 19A is formed into a substantially square plate-like shape which is eccentric toward the side opposed to the terminal fixing portion 19 with respect to the center line of the conductor connecting portion 43. This enables the aluminum-wire connecting terminal 33 and the copper-wire connecting terminal 37 to be formed so that, when the terminal fixing portions 19, 19A are superimposed on each other, the wires 23 do not overlap with each other.

As shown in FIG. 1, that is, the aluminum-wire connecting terminal 33 and copper-wire connecting terminal 37 which include the terminal connecting structure of the embodiment can be fixed to the body panel 41 in the state where the terminal fixing portions 19, 19A are electrically connected to each other. In the embodiment, therefore, the aluminum-wire connecting terminal 33 and the copper-wire connecting terminal 37 are overlappingly fixed to the body panel 41, thereby configuring a concentrated grounding system. Each of the aluminum-wire connecting terminal 33 and copper-wire connecting terminal 37 in the embodiment may be singly fixed to the body panel 41.

A bolt hole 47 through which a bolt 11 is to be passed is opened in each of the terminal fixing portions 19, 19A. When the bolt 11 which is passed through the bolt holes 47 is further passed through a bolt passing portion 41*a* of the body panel 41, and a nut 42 is screwed onto the tip end of the passed portion, the terminal fixing portions 19, 19A are fixed to the body panel 41 in the state where the portions are electrically conductive thereto. A thinned portion 49 for recycling is formed in each of the terminal fixing portions 19, 19A. When the wires 23 are pulled in disassembling by a predetermined force, therefore, the thinned portions 49 for recycling are broken, and parts of the terminal fixing portions 19, 19A can be torn off together with the wires 23. As a result, easy disassembling is enabled without canceling the tightening of the bolt 11. In the terminal fixing portions 19, 19A, conductive indentations 51 and clamping pieces 52 which are made contact with each other when the portions are overlaid each other are formed. In the aluminum-wire connecting terminal 33 and the copper-wire connecting terminal 37, therefore, the electric contact reliability in the use state in which the two terminals are superimposed on each other is enhanced.

Next, a terminal connecting method of the embodiment will be described.

The terminal connecting method of the embodiment has a conductor exposing step, a conductor connecting step, a waterproofing step, and a terminal connecting step. The method of connecting the aluminum-wire connecting terminal 33 is identical with that of connecting the copper-wire connecting terminal 37. Therefore, the method of connecting the aluminum-wire connecting terminal 33 will be exemplarily described hereinafter.

In the conductor exposing step, the conductor 27 of an end portion of each wire 23 in which the conductor 27 is covered by the insulative covering 29 is exposed by peeling off the covering 29.

In the conductor connecting step, the conductor exposed portions 13 of the plurality of aluminum wires 31 in which the conductors 27 are exposed are electrically connected to the conductor connecting portion 43 of the conductor connecting terminal 15 of the aluminum-wire connecting terminal 33. This connection is performed by the thermal bonding, the ultrasonic connection, or the like.

As shown in FIG. 3A, first, collected end portions of the plurality of aluminum wires 31 are placed on the conductor connecting portion 43 of the conductor connecting terminal 15, and the coverings 29 are crimped by the crimping claws 45.

In the connection by the ultrasonic connection, then, the conductor connecting portion 43 of the conductor connecting terminal 15 is placed on an anvil of an ultrasonic welder which is not shown, and a horn (vibrator) of the ultrasonic welder is placed so as to be paired with the anvil across the conductor exposed portions 13 placed on the conductor connecting portion 43. Then, the horn is ultrasonically vibrated in the state where the conductor exposed portions 13 are interposed between the anvil and the horn. When the horn is ultrasonically vibrated, the conductor exposed portions 13 are heated by friction, and the conductors 27, and the conductors 27 and the conductor connecting portion 43 are bonded together.

Figure 3B:
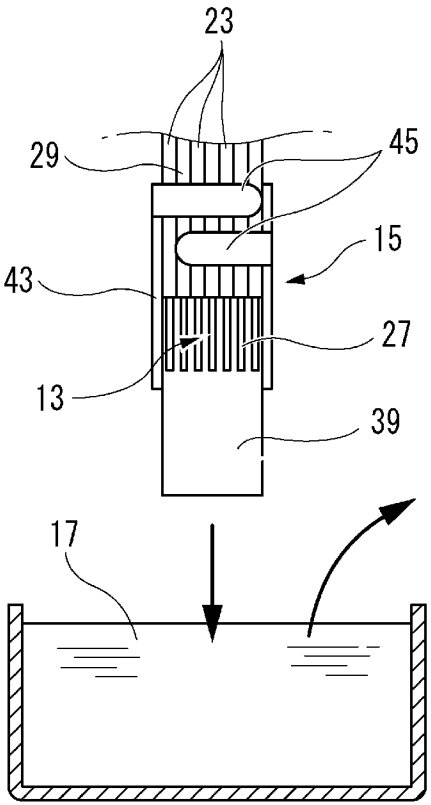
Figure 3C:
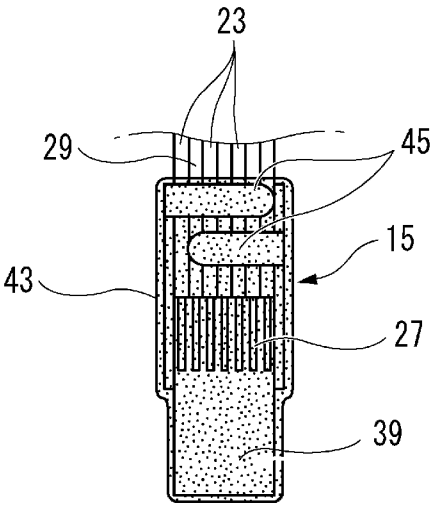

In the waterproofing step, at least the conductor exposed portions 13 in the conductor connecting terminal 15 are molded with the water sealant 17. The molding process is performed by the dipping method shown in FIG. 3.

In the terminal connecting step, while removing the water sealant 17, the conductor connecting terminal 15 is electrically connected to the fixing terminal 25 which is to be fixed to the body panel 41 to be electrically connected thereto.

In the case where the conductor connecting terminal 15 and the fixing terminal 25 are to be connected to each other by the thermal bonding or the ultrasonic connection as shown in FIGS. 4A to 4C, the water sealant 17 covering the portion where the conductor connecting terminal 15 and the fixing terminal 25 are to be connected to each other is removed by heat due to the thermal bonding or vibrations in the ultrasonic connection (see FIG. 4C).

In the case where the conductor connecting terminal 15 and the fixing terminal 25 are to be connected to each other by a male-female fitting structure as shown in FIGS. 5A to 5C, the water sealant 17 covering the portion where the conductor connecting terminal 15 and the fixing terminal 25 are to be connected to each other is scraped and removed by sliding contact due to the fitting (see FIG. 5C).

When the above-described process is performed on the aluminum-wire connecting terminal 33, the aluminum-wire connecting terminal 33 to which the aluminum wires 31 are connected is completed.

Next, the functions of the terminal connecting structure having the above configuration, and the terminal connecting method will be described.

In the terminal connecting structure of the embodiment, the aluminum-wire connecting terminal 33 and the copper-wire connecting terminal 37 are electrically connected in the conductor exposed portions 13 in which the coverings 29 are removed and the conductors 27 are exposed, to the conductor connecting terminals 33, 37 each having the conductor connecting terminal 15 and the fixing terminal 25, respectively. For example, the electrical connection is performed by the crimping connection, or the ultrasonic connection, the thermal bonding. Each of the conductor connecting terminals 15 to which the conductor exposed portions 13 are connected is immersed into a liquid water sealant 17 (subjected to the so-called dipping method) so that at least the whole of the conductor exposed portions 13 are submerged, to be molded with the water sealant 17. For example, the dipping method is performed by placing the conductor connecting terminal 15 attached to the end portions of the wires 23, in the lower side, holding the wires 23, and immersing the conductor connecting terminal 15 in the liquid water sealant 17. In this case, a water sealant having a high permeability is preferably used as the liquid water sealant 17. As a result, the wire connecting portion where the conductor connecting terminal 15 and the conductor exposed portions 13 are connected to each other is covered with a film formed by the water sealant 17. Namely, the film of the water sealant 17 used in the molding isolates the wire connecting portion from the exterior, to hold air-tightly and water-tightly the wire connecting portion.

The conductor connecting terminal 15 in which the wire connecting portion is molded with the water sealant 17 is electrically connected to the fixing terminal 25. The electrical connection of the conductor connecting terminal 15 and the fixing terminal 25 is performed by the male-female fitting structure, the thermal bonding, the ultrasonic connection, or the like. In this case, the water sealant 17 covering the fixing-terminal connecting portion 39 where the conductor connecting terminal 15 and the fixing terminal 25 are connected to each other is removed by the fitting, the thermal bonding, or the like.

In the terminal connecting structure of the embodiment, in the case where the aluminum wires 31 and copper wires 35 which are configured by the conductors 27 of different kinds of metals are to be connected to each other, the wires 23 are connected to the corresponding conductor connecting terminal 15 depending on the kinds of metals of the conductors 27. For example, aluminum conductors are connected to the conductor connecting terminal 15 of the aluminum-wire connecting terminal 33, and copper conductors are connected to the conductor connecting terminal 15 of the copper-wire connecting terminal 37. The conductor connecting terminal 15 to which the aluminum conductors are connected, and the conductor connecting terminal 15 to which the copper conductors are connected are assembled integrally with the fixing terminals 25 to be configured as the aluminum-wire connecting terminal 33 and the copper-wire connecting terminal 37, respectively. The aluminum-wire connecting terminal 33 and the copper-wire connecting terminal 37 are fixed to the body panel 41 while their terminal fixing portions 19, 19A are superimposed on and integrated with each other. Therefore, the aluminum conductors and copper conductors which are made of different kinds of metals are not in contact with each other. According to the configuration, it is possible to suppress so-called galvanic corrosion in which corrosion of a metal having a lower corrosion potential (for example, aluminum) is promoted depending on the difference between the corrosion potentials of different kinds of metals.

In the terminal connecting structure of the embodiment, the conductor connecting terminal 15 to which the wires 23 are connected, and in which the wire connecting portion is molded with the water sealant 17 is assembled integrally with the fixing terminal 25 by the fitting structure. In the fitting structure, the fixing-terminal connecting portion 39 of the conductor connecting terminal 15 is in sliding contact with the fixing terminal 25. The water sealant 17 covering the fixing-terminal connecting portion 39 of the conductor connecting terminal 15 is scraped and removed by the fitting operation in the fitting. As a result of completion of the fitting, the fixing-terminal connecting portion 39 from which the water sealant 17 is removed is conductively connected to the fixing terminal 25.

In another terminal connecting structure of the embodiment, the conductor connecting terminal 15 to which the wires 23 are connected, and in which the wire connecting portion is molded with the water sealant 17 is assembled integrally with the fixing terminal 25 by thermal bonding. The thermal bonding is performed by, for example, thermal welding or thermocompression bonding. The water sealant 17 covering the fixing-terminal connecting portion 39 of the conductor connecting terminal 15 is melted and removed by heat which is generated in the bonding. As a result of completion of the thermal bonding, the fixing-terminal connecting portion 39 from which the water sealant 17 is removed is conductively connected to the fixing terminal 25.

In a further terminal connecting structure of the embodiment, the conductor connecting terminal 15 to which the wires 23 are connected, and in which the wire connecting portion is molded with the water sealant 17 is assembled integrally with the fixing terminal 25 by ultrasonic connection. The ultrasonic connection is performed by, for example, applying ultrasonic vibrations to the bonding surfaces of the fixing terminal 25 and the conductor connecting terminal 15. The water sealant 17 covering the fixing-terminal connecting portion 39 of the conductor connecting terminal 15 is removed by vibrations and heat which are generated in the bonding. As a result of completion of the ultrasonic connection, the fixing-terminal connecting portion 39 from which the water sealant 17 is removed is conductively connected to the fixing terminal 25.

In the terminal connecting method of the embodiment, the conductors 27 of the wires 23 are exposed in the conductor connecting step. The exposed conductor exposed portions 13 are connected to the conductor connecting terminal 15 in the terminal connecting step. In the conductor connecting terminal 15 to which the conductor exposed portions 13 are connected, at least the wire connecting portion is immersed in the liquid water sealant 17 to be molded, in the waterproofing step. The molding is performed by the so-called dipping method. For example, the dipping method is performed by placing the conductor connecting terminal 15 attached to the end portions of the wires 23, in the lower side, holding the wires 23, and immersing the conductor connecting terminal 15 in the liquid water sealant 17. In this case, the water sealant 17 adheres to the fixing-terminal connecting portion 39 of the conductor connecting terminal 15 which is located below the conductor exposed portions 13.

The film formed by the water sealant 17 is removed by scraping due to fitting, heat due to thermal welding, or the like when the connection of the conductor connecting terminal and the fixing terminal is performed in the conductor connecting step by the male-female fitting structure, the welding, the ultrasonic connection, or the like.

Figure 6A:
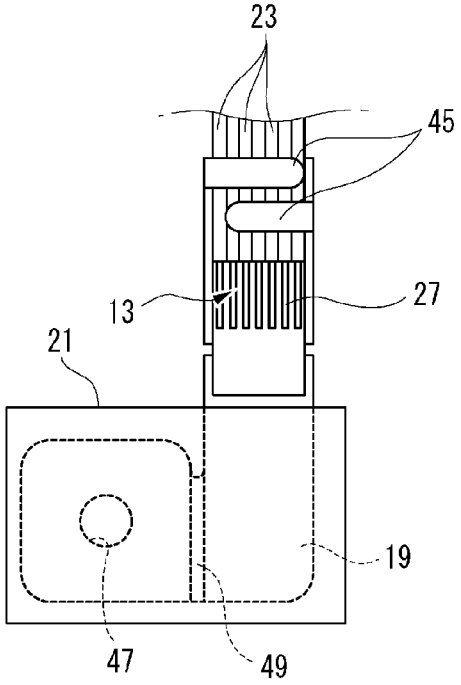
FIG. 6A is a front view of a connecting terminal of a comparative example in which a terminal fixing portion is masked.
Figure 6B:
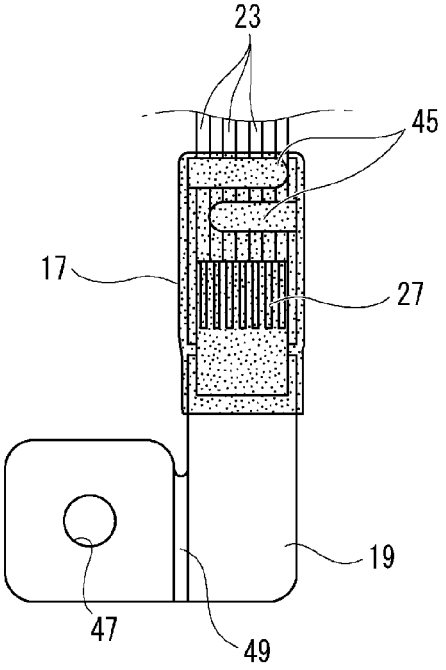
FIG. 6B is a front view of the connecting terminal of the comparative example in which the masking is removed after the waterproofing step shown in FIG. 6A.
Figure 7A:
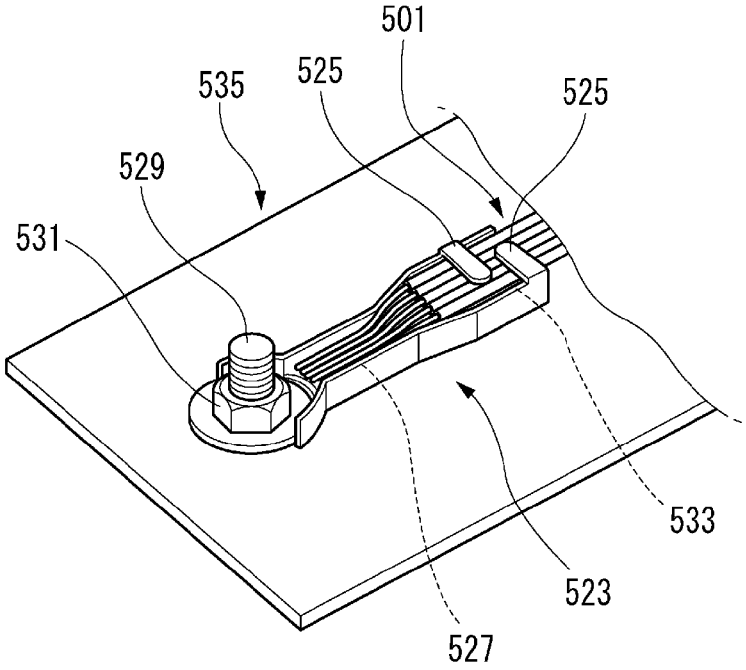
FIG. 7A is a sectional view showing a state where a connecting portion of a related-art waterproofing bolted terminal is subjected to a waterproofing process.
Figure 7B:
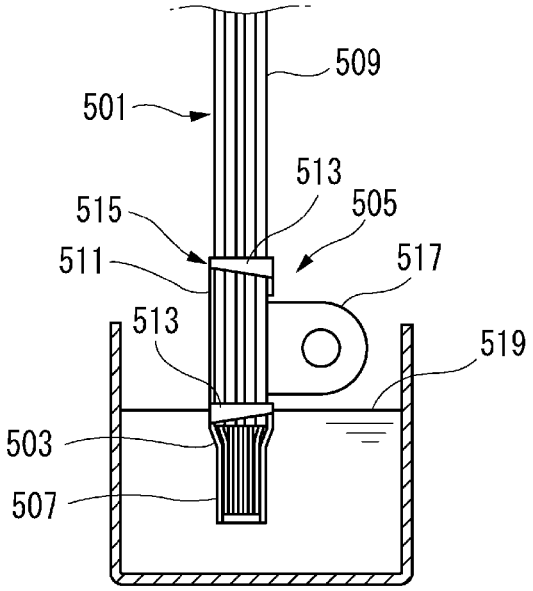
FIG. 7B is a perspective view of a related-art attaching structure.

In the molding by the water sealant 17, therefore, it is not necessary to perform cumbersome works of, after application of masking 21 such as shown in FIG. 6A, performing the molding process, and further peeling off the masking.

According to the terminal connecting structure and terminal connecting method of the embodiment, therefore, the masking 21 is not necessary, and waterproof and corrosion proof are enabled by the dipping method.

Features of the above-described embodiment of the terminal connecting structure and method of the invention are listed below in a brief and summarized manner.

(1) The terminal connecting structure includes: the electric wires 23 in each of which the conductor 27 is covered by the insulative covering 29; the conductor connecting terminal 15 to which the conductor exposed portions 13 in which the coverings 29 of the end portions of the wires 23 are removed and the conductors 27 are exposed are electrically connected; the water sealant 17 for molding the conductor connecting terminal 15; and the fixing terminal 25 which has the terminal fixing portion 19 or 19A that is to be fixed and electrically connected to the mount part (body panel 41), and which is electrically connected to the conductor connecting terminal 15 in the state where the water sealant 17 is removed.

(2) In the terminal connecting structure of (1) above, the terminal connecting structure is to be fixed to the mount part (body panel 41) in the state where the terminal fixing portions 19, 19A of the plurality of fixing terminals 25 are electrically connected to each other.

(3) In the terminal connecting structure of (1) or (2) above, the water sealant 17 which covers the fixing-terminal connecting portion 39 of the conductor connecting terminal 15 contacting with the fixing terminal 25 is scraped and removed by the fitting operation of the fitting structure of the conductor connecting terminal 15 and the fixing terminal 25.

(4) In the terminal connecting structure of (1) or (2) above, the water sealant 17 which covers the fixing-terminal connecting portion 39 of the conductor connecting terminal 15 contacting with the fixing terminal 25 is melted and removed by heat due to the thermal bonding between the conductor connecting terminal 15 and the fixing terminal 25.

(5) In the terminal connecting structure of (1) or (2) above, the water sealant 17 which covers the fixing-terminal connecting portion 39 of the conductor connecting terminal 15 contacting with the fixing terminal 25 is removed by vibrations and heat due to the ultrasonic connection between the conductor connecting terminal 15 and the fixing terminal 25.

(6) The terminal connecting method includes: the conductor exposing step of exposing the conductors 27 of the end portions of the wires 23 in each of which the conductor 27 is covered by the insulative covering 29; the conductor connecting step of electrically connecting the conductor exposed portions 13 of the wires 23 in which the conductors 27 are exposed, to the conductor connecting terminal 15; the waterproofing step of molding at least the conductor exposed portions 13 in the conductor connecting terminal 15, with the water sealant 17; and the terminal connecting step of electrically connecting the conductor connecting terminal 15 to the fixing terminal 25 which has the terminal fixing portion 19 or 19A that is to be fixed and electrically connected to the mount part (body panel 41), while removing the water sealant 17.

According to an aspect of the invention, there is provided a terminal connecting structure comprising: an electric wire in which a conductor is covered by an insulative covering; a conductor connecting terminal to which a conductor exposed portion in which the covering of an end portion of the electric wire is removed and the conductor is exposed is electrically connected; a water sealant for molding the conductor connecting terminal; and a fixing terminal which includes a terminal fixing portion that is to be fixed and electrically connected to a mount part, and which is electrically connected to a part of the conductor connecting terminal in a state where the water sealant is removed from the part of the conductor connecting terminal.

According to the terminal connecting structure having the above configuration, the connecting terminal includes the conductor connecting terminal and the fixing terminal. The conductor exposed portion in which the covering is removed is electrically connected to the conductor connecting terminal. For example, the electrical connection is performed by the crimping connection, the ultrasonic connection, or the thermal bonding. The conductor connecting terminal to which the conductor exposed portion is connected is immersed into a liquid water sealant (subjected to the so-called dipping method) so that at least the whole of the conductor exposed portion is submerged, to be molded with the water sealant. For example, the dipping method is performed by placing the conductor connecting terminal attached to the end portion of the electric wire, in the lower side, holding the electric wire, and immersing the conductor connecting terminal in the liquid water sealant. In this case, a water sealant having a high permeability is preferably used. As a result, the wire connecting portion where the conductor connecting terminal and the conductor exposed portion are connected to each other is covered with a film formed by the water sealant. Namely, the film of the water sealant used in the molding isolates the wire connecting portion from the exterior, to hold air-tightly and water-tightly the wire connecting portion.

The conductor connecting terminal in which the wire connecting portion is molded with the water sealant is electrically connected to the fixing terminal. The electrical connection of the conductor connecting terminal and the fixing terminal is performed by the male-female fitting structure, the thermal bonding, the ultrasonic connection, or the like. In this case, the water sealant covering the connecting portion where the conductor connecting terminal and the fixing terminal are connected to each other is removed by scraping in the male-female fitting, heat in the thermal bonding, or the like.

The terminal connecting structure may be fixed to the mount part in a state where the terminal fixing portions of a plurality of the fixing terminals are electrically connected to each other.

According to the terminal connecting structure having the above configuration, in the case where electric wires having different kinds of metals are to be connected to each other, the electric wires can be connected to the corresponding conductor connecting terminal depending on the kinds of metals of the conductors. For example, aluminum conductors are connected to a conductor connecting terminal for aluminum wires, and copper conductors are connected to a conductor connecting terminal for copper wires. Namely, a conductor connecting terminal for aluminum wires to which aluminum conductors are connected, and a conductor connecting terminal for copper wires to which copper conductors are connected are assembled integrally with the fixing terminals to be configured as an aluminum-wire terminal and a copper-wire terminal, respectively. The aluminum-wire terminal and the copper-wire terminal are fixed to the mount part while their terminal fixing portions are superimposed on and integrated with each other. Therefore, the aluminum conductors and copper conductors which are made of different kinds of metals are not in contact with each other. According to the configuration, it is possible to suppress so-called galvanic corrosion in which corrosion of a metal having a lower corrosion potential (for example, aluminum) is promoted depending on the difference between the corrosion potentials of different kinds of metals.

The water sealant which covers a fixing-terminal connecting portion of the conductor connecting terminal contacting with the fixing terminal may be scraped and removed by a fitting operation when the conductor connecting terminal and the fixing terminal are fitted to each other.

According to the terminal connecting structure having the above configuration, the conductor connecting terminal to which the electric wire is connected, and in which the wire connecting portion is molded with the water sealant is assembled integrally with the fixing terminal by the fitting structure. In the fitting structure, the fixing-terminal connecting portion of the conductor connecting terminal is in sliding contact with the fixing terminal. The water sealant covering the fixing-terminal connecting portion of the conductor connecting terminal is scraped and removed by the fitting operation in the fitting. As a result of completion of the fitting, the fixing-terminal connecting portion from which the water sealant is removed is conductively connected to the fixing terminal.

The water sealant which covers a fixing-terminal connecting portion of the conductor connecting terminal contacting with the fixing terminal may be melted and removed by heat due to thermal bonding when the conductor connecting terminal and the fixing terminal are thermally bonded to each other.

According to the terminal connecting structure having the above configuration, the conductor connecting terminal to which the electric wire is connected, and in which the wire connecting portion is molded with the water sealant is assembled integrally with the fixing terminal by thermal bonding. The thermal bonding is performed by, for example, thermal welding or thermocompression bonding. The water sealant covering the fixing-terminal connecting portion of the conductor connecting terminal is melted and removed by heat which is generated in the thermal bonding. As a result of completion of the thermal bonding, the fixing-terminal connecting portion from which the water sealant is removed is conductively connected to the fixing terminal.

The water sealant which covers a fixing-terminal connecting portion of the conductor connecting terminal contacting with the fixing terminal may be removed by vibrations and heat due to ultrasonic connection when the conductor connecting terminal and the fixing terminal are ultrasonically connected to each other.

According to the terminal connecting structure having the above configuration, the conductor connecting terminal to which the electric wire is connected, and in which the wire connecting portion is molded with the water sealant is assembled integrally with the fixing terminal by ultrasonic connection. The ultrasonic connection is performed by, for example, applying ultrasonic vibrations to the bonding surfaces of the fixing terminal and the conductor connecting terminal. The water sealant covering the fixing-terminal connecting portion of the conductor connecting terminal is removed by vibrations and heat which are generated in the ultrasonic connection. As a result of completion of the ultrasonic connection, the fixing-terminal connecting portion from which the water sealant is removed is conductively connected to the fixing terminal.

There is also provided a terminal connecting method comprising: exposing a conductor of an end portion of an electric wire in which the conductor is covered by an insulative covering; electrically connecting a conductor exposed portion of the electric wire in which the conductor is exposed, to a conductor connecting terminal; molding at least the conductor exposed portion in the conductor connecting terminal, with a water sealant; and electrically connecting a part of the conductor connecting terminal to a fixing terminal which includes a terminal fixing portion that is to be fixed and electrically connected to a mount part, while removing the water sealant from the part of the conductor connecting terminal.

In the terminal connecting method having the above configuration, the conductor of the electric wire is exposed in the conductor connecting step. The exposed conductor exposed portion is connected to the conductor connecting terminal in the terminal connecting step. In the conductor connecting terminal to which the conductor exposed portion is connected, at least the wire connecting portion is immersed in the liquid water sealant to be molded, in the waterproofing step. The molding is performed by the so-called dipping method. For example, the dipping method is performed by placing the conductor connecting terminal attached to the end portion of the electric wire, in the lower side, holding the electric wire, and immersing the conductor connecting terminal in the liquid water sealant. In this case, the water sealant adheres to the fixing-terminal connecting portion of the conductor connecting terminal which is located below the conductor exposed portion.

The film formed by the water sealant is removed by scraping due to fitting, heat due to thermal welding, or the like when the connection of the conductor connecting terminal and the fixing terminal is performed in the conductor connecting step by the male-female fitting structure, the welding, the ultrasonic connection, or the like.

In the molding with the water sealant, therefore, it is not necessary to perform a cumbersome work of, after application of masking, performing the molding process.

According to the terminal connecting structure and terminal connecting method of the invention, masking is not necessary, and waterproof and corrosion proof by the dipping method are enabled.

The invention is not limited to the above-described embodiment, and may be adequately subjected to modifications, improvements, and the like. In addition, the materials, shapes, dimensions, values, forms, numbers, places, and the like of the components of the above-described embodiment are arbitrary and not limited insofar as the invention is achieved.

What is claimed is:

1. A terminal connecting structure comprising:

an electric wire in which a conductor is covered by an insulative covering;

a conductor connecting terminal to which a conductor exposed portion in which the covering of an end portion of the electric wire is removed and the conductor is exposed is electrically connected;

a water sealant molded to cover at least the conductor exposed portion in the conductor connecting terminal; and a fixing terminal which includes a terminal fixing portion that is to be fixed and electrically connected to a mount part, and which is to be fixed to and electrically connected to a part of the conductor connecting terminal in a state where the water sealant is removed from the part of the conductor connecting terminal.

2. The terminal connecting structure according to claim 1, wherein the terminal connecting structure is to be fixed to the mount part in a state where the terminal fixing portions of a plurality of the fixing terminals are electrically connected to each other.

3. The terminal connecting structure according to claim 1, wherein the water sealant, covering a fixing-terminal connecting portion of the conductor connecting terminal contacting with the fixing terminal, is configured to be scraped and removed by a fitted connection between the conductor connecting terminal and the fixing terminal.

4. The terminal connecting structure according to claim 1, wherein the water sealant covering a fixing-terminal connecting portion of the conductor connecting terminal contacting with the fixing terminal, is configured to be melted and removed by a thermal bond between the conductor connecting terminal and the fixing terminal.

5. The terminal connecting structure according to claim 1, wherein the water sealant, covering a fixing-terminal connecting portion of the conductor connecting terminal contacting with the fixing terminal, is configured to be removed by an ultrasonic bond between the conductor connecting terminal and the fixing terminal.

6. The terminal connecting structure according to claim 1, wherein the water sealant is molded to and completely encapsulates the conductor connected terminal.

7. A terminal connecting method comprising:

exposing a conductor of an end portion of an electric wire in which the conductor is covered by an insulative covering;

electrically connecting a conductor exposed portion of the electric wire in which the conductor is exposed, to a conductor connecting terminal;

molding at least the conductor exposed portion in the conductor connecting terminal, with a water sealant; and electrically connecting a part of the conductor connecting terminal to a fixing terminal which includes a terminal fixing portion that is to be fixed and electrically connected to a mount part, while removing the water sealant from the part of the conductor connecting terminal.

* * * * *